US006896556B1

(12) United States Patent
Wu

(10) Patent No.: US 6,896,556 B1
(45) Date of Patent: May 24, 2005

(54) CABLE ASSEMBLY WITH POWER ADAPTER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/764,748

(22) Filed: Jan. 26, 2004

(51) Int. Cl.[7] ..... H01R 25/00; H01R 27/02
(52) U.S. Cl. ..... 439/638; 439/660
(58) Field of Search ..... 439/660, 362–366, 439/378, 638–641, 628

(56) References Cited

U.S. PATENT DOCUMENTS

| | | | | |
|---|---|---|---|---|
| D412,700 | S | 8/1999 | Gardner et al. | |
| 6,176,743 | B1 * | 1/2001 | Kuo | 439/638 |
| 6,319,066 | B2 * | 11/2001 | Kuo | 439/638 |
| 6,343,957 | B1 * | 2/2002 | Kuo et al. | 439/638 |
| 6,776,664 | B1 * | 8/2004 | Huang | 439/660 |

FOREIGN PATENT DOCUMENTS

| | | |
|---|---|---|
| TW | 475792 | 2/2002 |
| TW | 517885 | 1/2003 |

* cited by examiner

*Primary Examiner*—Michael C. Zarroli
(74) *Attorney, Agent, or Firm*—Wei Te Chung

(57) ABSTRACT

A cable assembly (100) includes a first connector (1) including a first insulating housing (10) extending in a lengthwise direction and a number of first and second contacts (11, 12) received in the first housing in a lateral direction perpendicular to the lengthwise direction, a cable (3) including a number of conductors (302, 304) electrically connecting with the first contacts, a second connector including a second housing (20) back to back assembled to the first housing and a number of third contacts (22) electrically connecting with the second contacts of the first connector, and a pair of screw caps (5). The first insulating housing defines a pair of fitting spaces (1073) extending in the lengthwise direction and a pair of mounting holes (1071) extending in the lateral direction and respectively communicating with the fitting spaces, and the pair of screw caps are respectively received in the fitting spaces in the lengthwise direction.

15 Claims, 12 Drawing Sheets

CABLE ASSEMBLY WITH POWER ADAPTER

CROSS-REFERENCE TO RELATED APPLICATIONS

This patent application is related to U.S. patent application Ser. Nos. 10/385,794 filed on Mar. 10, 2003 and entitled "ELECTRICAL ADAPTER", 10/668,739 filed on Sep. 23, 2003 and entitled "CABLE ASSEMBLY WITH POWER ADAPTER", both of which are invented by the same inventor and assigned to the same assignee as this application.

BACKGROUND OF THE INVENTION

1. Field of the Invention

The present invention relates to a cable assembly, and particularly to a cable assembly having a cable connector and a power adapter respectively for signal and power transmission.

2. Description of Related Art

In recent days, an electrical connector known as a Serial Advanced Technology Attachment (Serial ATA) connector, according to the newly developed Serial ATA interface standard, is developed to be generally used for connecting storage peripheral devices such as hard disk drives with a mother printed circuit board so as to achieve signal or power transmission therebetween. The Serial ATA connector has many advantages such as low voltage requirement, low pin count and high speed transmission.

A pair of Serial ATA power cable assemblies are generally employed to perform power transmission between the storage peripheral device and the mother printed circuit board. Each Serial ATA power cable assembly comprises a cable with two Serial ATA power connectors terminating at two opposite ends thereof, one of which is connected to the mother printed circuit board or the storage peripheral device and another of which is adapted to mate with one of the connectors of another cable assembly. When the two matable Serial ATA power connectors mate with each other, a power transmission is thus established between the storage peripheral device and the mother printed circuit board. However, in some particular circumstances, the two matable Serial ATA power connectors of the pair of cable assemblies do not directly mate with each other. Accordingly, a power adapter is required for connecting these two matable Serial ATA power connectors together.

On the other hand, two separate connectors are generally provided to respectively perform the signal and power transmission between the storage peripheral device and the mother printed circuit board. However, forming the two separate connectors is expensive and inconvenient compared to the formation of a unitary member which can perform the functions of signal and power transmission.

Hence, a cable assembly having a cable connector and a power adapter respectively for signal and power transmission is highly desired.

SUMMARY OF THE INVENTION

Accordingly, an object of the present invention is to provide a cable assembly having a cable connector and a power adapter respectively for signal and power transmission with inlayed bolts.

In order to achieve the object set forth, a cable assembly in accordance with the present invention comprises a first connector, a cable and a second connector both electrically connecting to the first connector. The first connector comprises a first insulating housing having an elongated base extending in a lengthwise direction with a first and a second mating ports integrally extending from one side thereof, and a plurality of first and second contacts received in the first and the second mating ports in a lateral direction perpendicular to the lengthwise direction, respectively. The cable and the second connector are attached to the other side of the base in the lengthwise direction. The cable comprises a plurality of conductors electrically connecting with the first contacts. The second connector comprises a second housing back to back assembled to the first housing and a plurality of third contacts electrically connecting with the second contacts. The base of the first insulating housing defines a pair of fitting spaces extending in the lengthwise direction and a pair of mounting holes extending in the lateral direction and respectively communicating with the fitting spaces. A pair of screw caps are respectively assembled to the fitting spaces in the lateral direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of ent invention.

Figure 1:
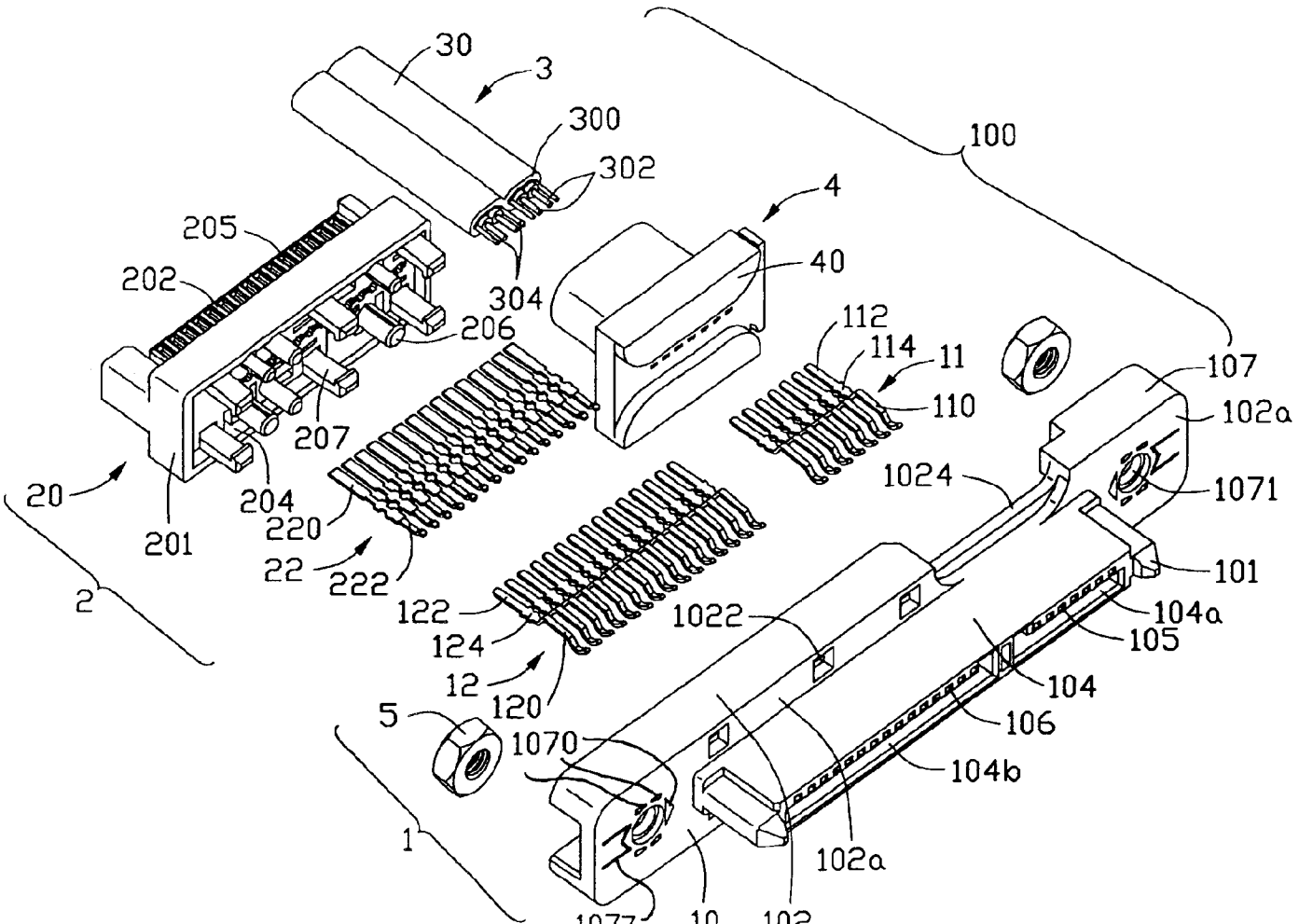
FIG. 1 is an exploded, perspective view of a cable assembly in accordance with the present invention
Figure 2:
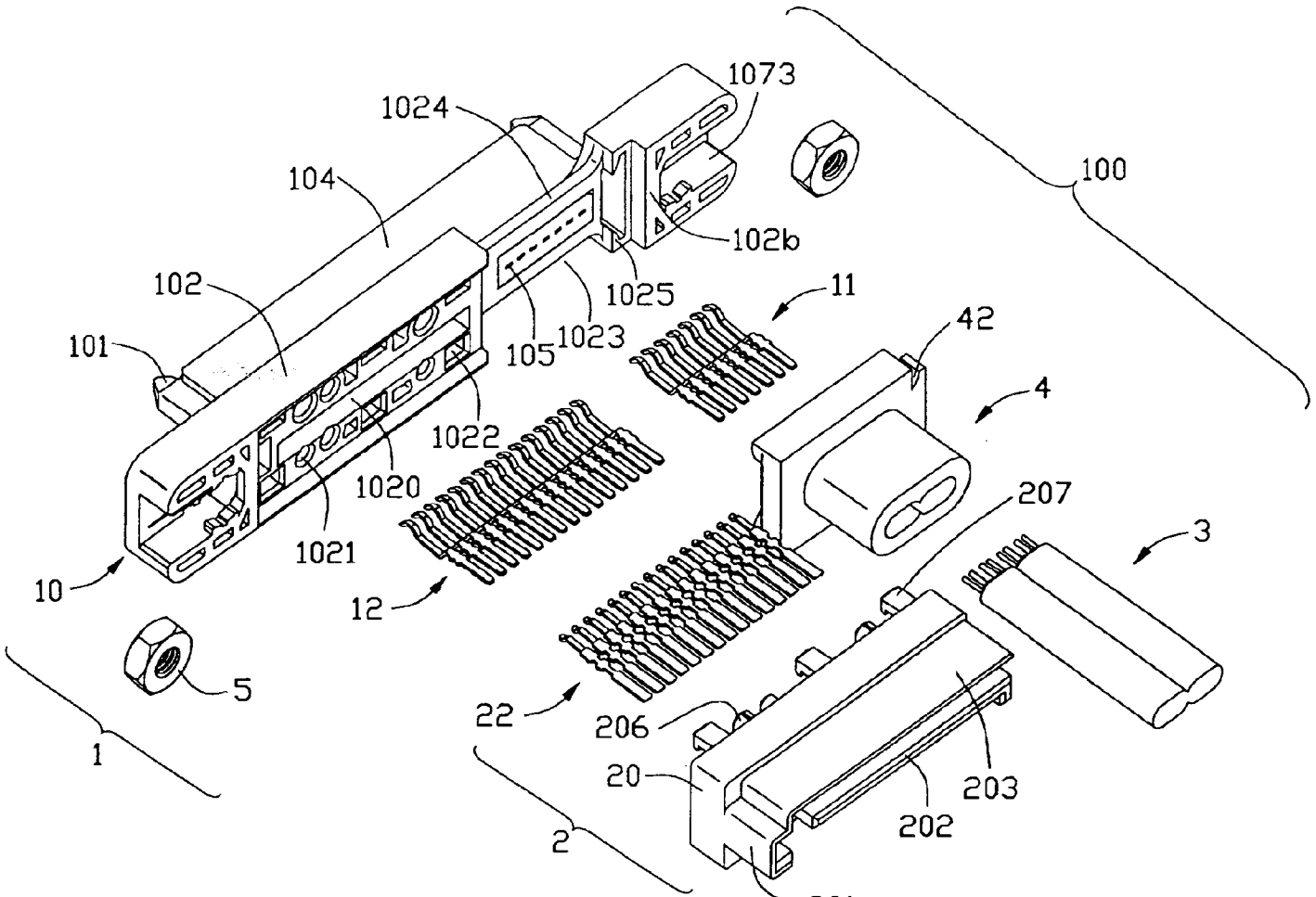
FIGS. 2 and 3 are views similar to FIG. 1, but taken from different aspects.
Figure 3:
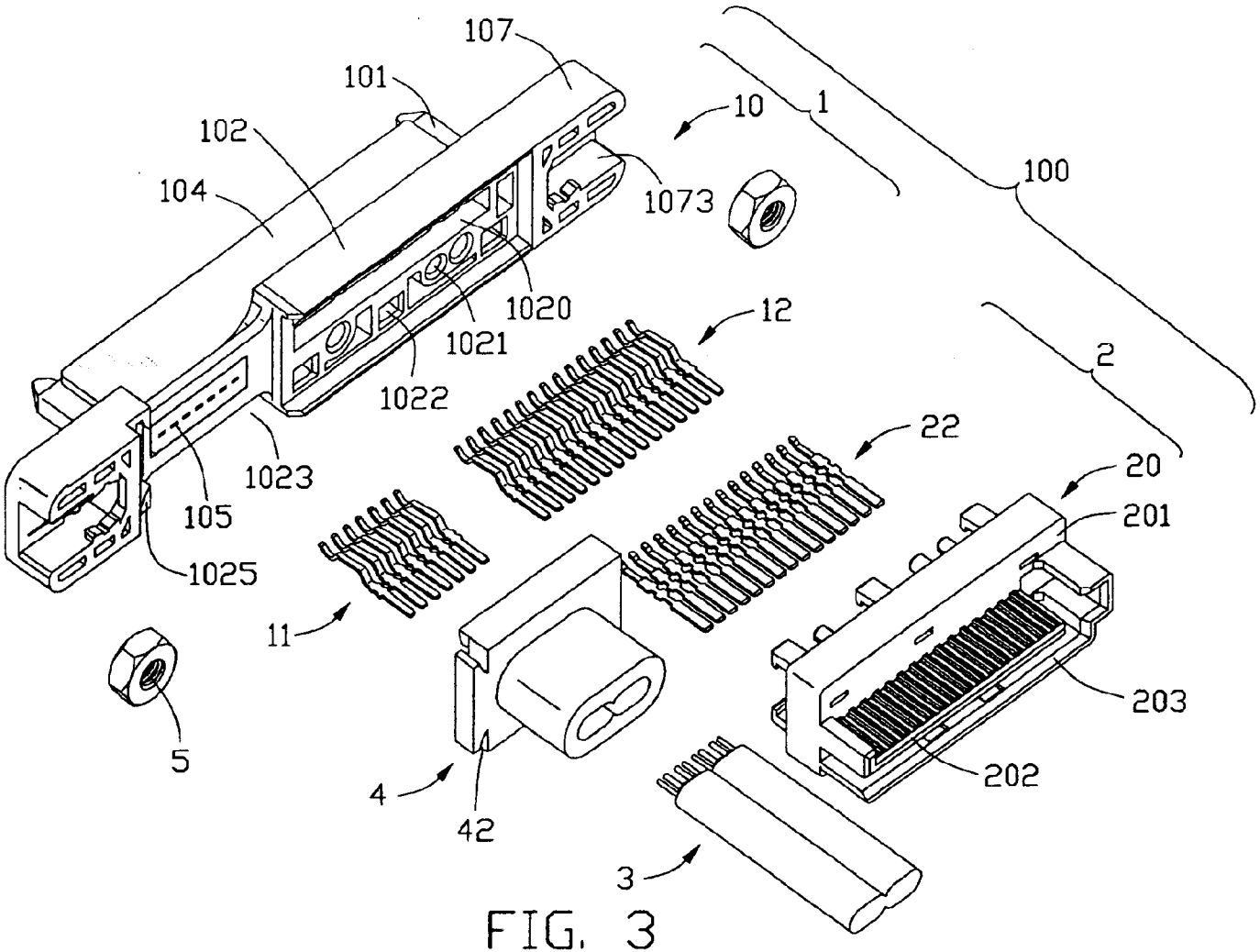

Referring to FIGS. 1–3, a cable assembly 100 in accordance with the invention comprises a first connector 1, a second connector 2 back to back ed to the first connector 1, a cable 3 terminated to the first connector 1 and a cover 4 overmolded with the cable 3 and the first connector 1. In a preferred embodiment, the first connector 1 is a Serial Advanced Technology Attachment (Serial ATA) receptacle connector. The second connector 2 is a Serial ATA plug connector. The cable 3 is a Serial ATA cable.

The first connector 1 comprises a first insulating housing 10, a plurality of first and second receptacle contacts 11, 12 retained in the first housing 10, and a pair of screw caps 5 assembled to the first insulating housing 10. The first housing 10 has an elongate base 102 and a mating section 104 extending perpendicularly and forwardly from a front face 102*a* of the base 102. A pair of guiding posts 101 is disposed at opposite ends of the mating section 104 for guiding the first connector 1 to mate with a first complementary connector (not shown).

Figure 5:
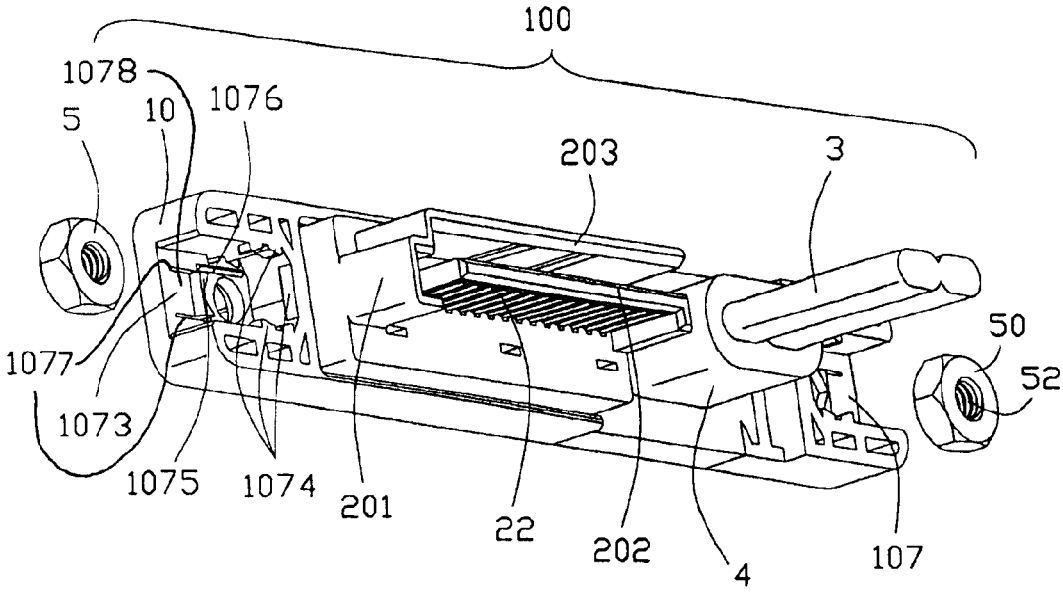
FIGS. 5 and 6 are views similar to FIG. 4, but taken from different aspects.
Figure 6:
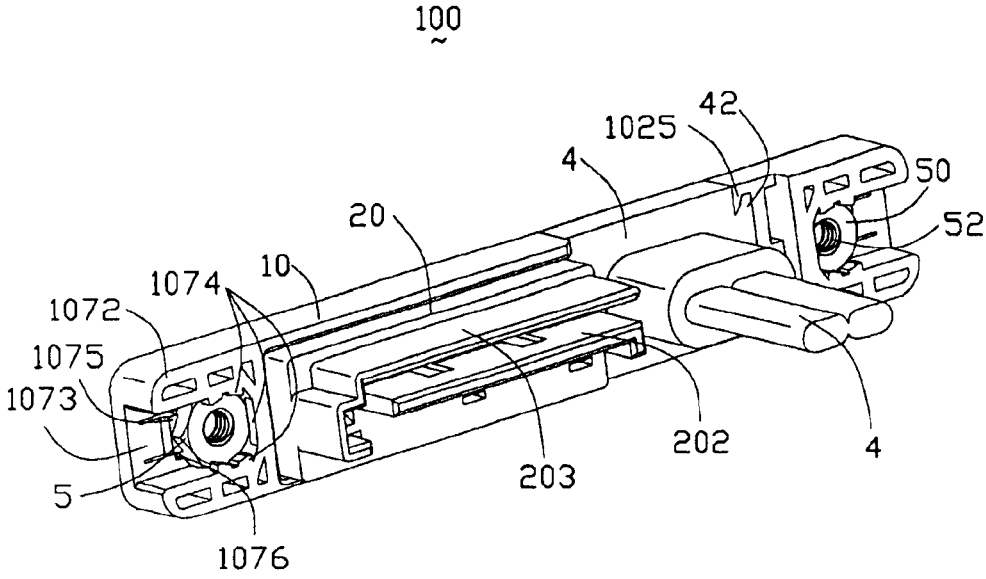

Referring to FIGS. 1–3 in conjunction with FIGS. 5–6, the mating section 104 includes a first and a second mating ports 104*a*, 104*b* arranged in a side-by-side manner wherein the first mating port 104*a* has a lengthwise dimension smaller than that of the second mating port 104*b*. A polarizing key 108 (FIG. 8) is formed on the mating section 104 and closely adjacent to the base 102. The base 102 defines a cavity 1020 extending therethrough to communicate with the second mating port 104*b*, and a plurality of holes 1021 and slots 1022 located at upper and lower sides of the cavity 1020. The base 102 is formed with a projection 1022*a* (shown in FIG. 12) in each slot 1022. The base 102 defines a receiving space 1023 corresponding to the first mating port 104*a* in a rear face 102*b* thereof, and a pair of depressions 1024 communicating with the receiving space 1023 in top and bottom faces thereof. The base 102 is further formed with a pair of barbs 1025 in the receiving space 1023 and forms a pair of flanges 107 at opposite ends thereof. The first housing 10 defines a plurality of first passageways 105 communicating with the first mating port 104*a* and the receiving space 1023, and a plurality of second passageways 106 communicating with the second mating port 104*b* and the cavity 1020. Each flange 107 of the base 102 defines a mounting hole 1071 extending from the front face 102*a* to the rear face 102*b*.

Particularly referring to FIGS. 5–6, a fitting space 1073 is defined in the flange 107 in a lengthwise direction of the base 102 to communicate with the rear face 102*b* and the mounting hole 1071. A plurality of first blocks 1074 are respectively formed on opposite upper and lower surfaces and a side surface of the fitting space 1073 adjacent to the rear face 102*b*. A swallow-tailed second block 1075 and a pair of third blocks 1076 are respectively formed on a front surface of the fitting space 1073 adjacent to the front face 102*a* of the base 102. The pair of third blocks 1076 extend along the lengthwise direction of the base 102, while the second block 1075 extends along a direction perpendicular to the lengthwise direction. It is noted that for complying with the molding consideration, to form the first blocks 1074, the flange 107 requires to form the through openings 1070 in alignment with the first blocks 1074, respectively, along a front-to-back direction. On the other hand, an M-shaped through slot is formed in the flange 107 so as to form a deflectable finger 1078 with the second block 1075 on the back for allowing installation of the screw cap 5 into the fitting space 1073 along the lengthwise direction.

Figure 11:
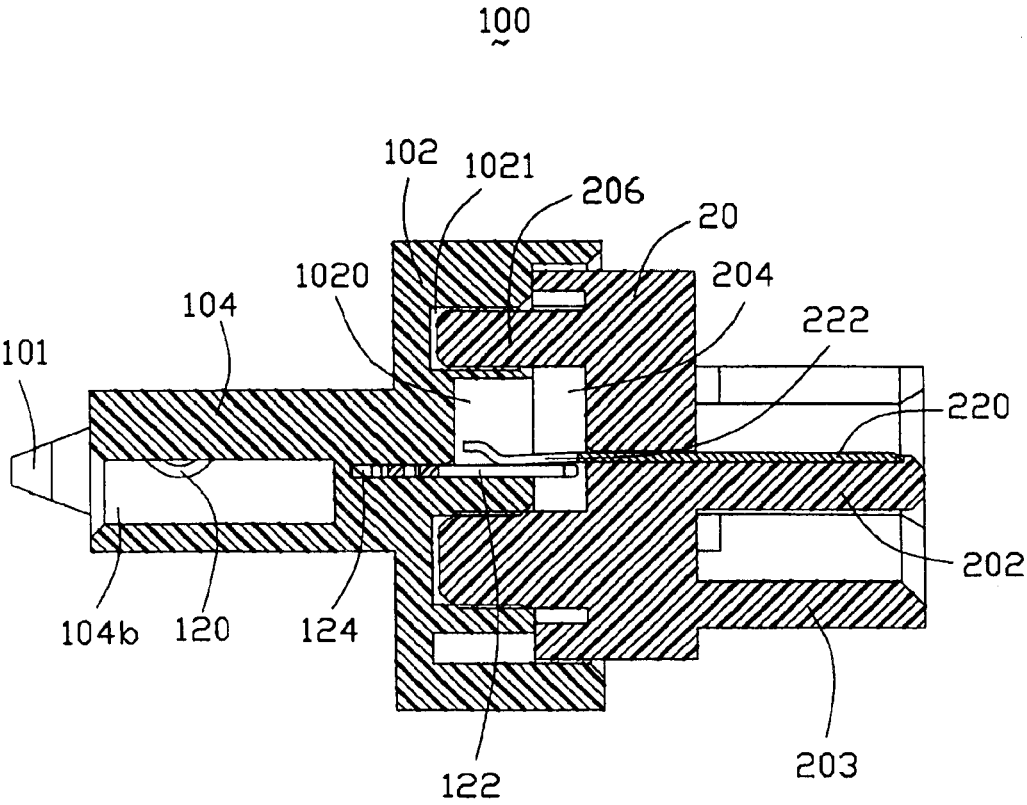
FIG. 11 is a cross-sectional view taken along line 11—11 of FIG. 4.
Figure 12:
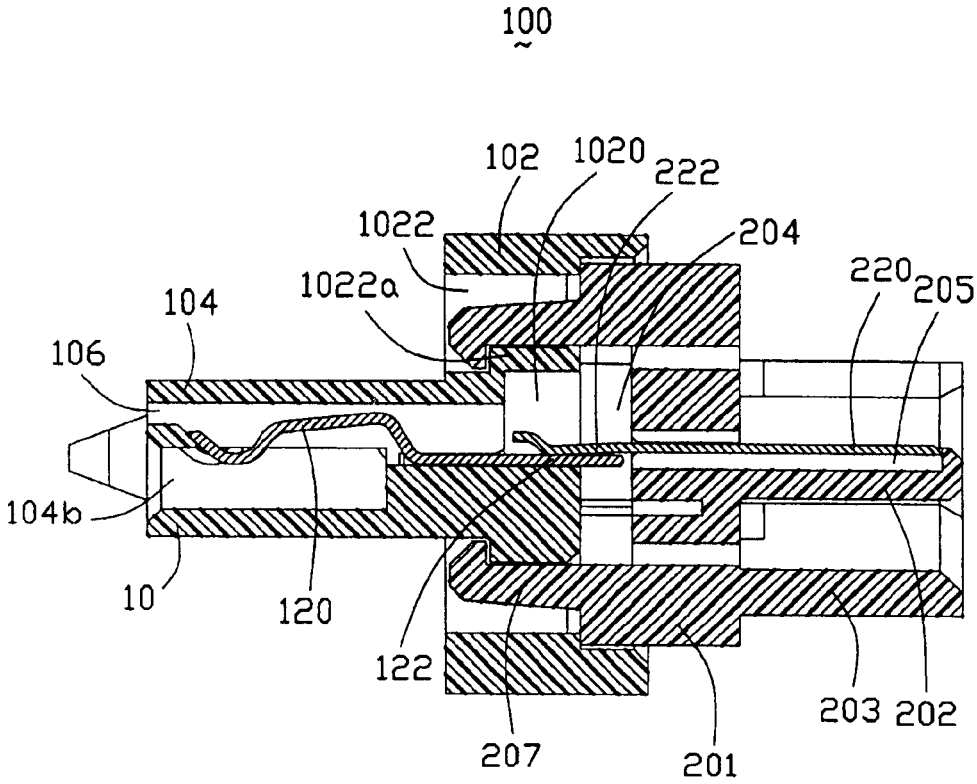
FIG. 12 is a cross-sectional view taken along line 12—12 of FIG. 4.

In conjunction with FIGS. 11–12, the first and the second receptacle contacts 11, 12 are assembled into the first and the second passageways 105, 106, respectively. The first receptacle contacts 11 has four signal contacts and three ground contacts and each include an engaging portion 110 received in the first mating port 104*a*, a tail portion 112 rearwardly extending out of the base 102 for connecting to the cable 3, and an intermediate portion 114 interconnecting the engaging portion 110 with the tail portion 112. The second receptacle contacts 12 are power contacts and each include a contact portion 120 received in the second mating port 104*b*, a connecting portion 122 extending rearwardly beyond an inner face of the cavity 1020, and a middle portion 124 interconnecting the contact portion 120 and the connecting portion 122.

Referring to FIG. 6, each screw cap 5 is a standard element for economy and comprises a cylindrical post 50 with a threaded bole 52 defined through the cylindrical post 50. The screw caps 5 are respectively received in the fitting space 1073 of the flanges 107 of the base 102. The first blocks 1074 respectively abut against a rear face of the cylindrical post 50 of the screw cap 5 for preventing the screw cap 5 from separating from the fitting space 1073. The second block 1075 and the pair of third blocks 1076 are respectively abut against the peripheral of the screw cap 5 for preventing the screw cap 5 from loosing.

Figure 8:
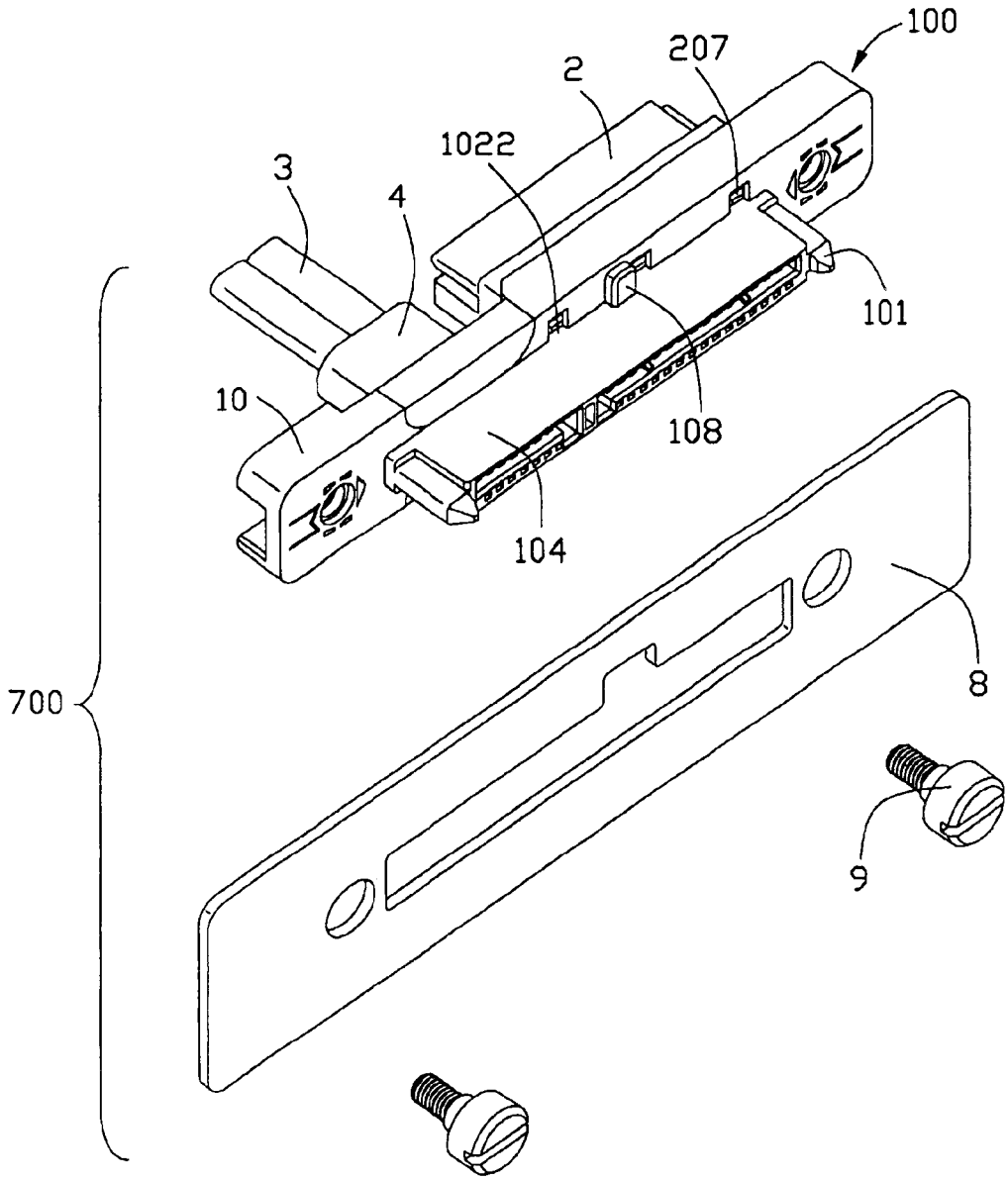

Referring to FIG. 8, two receptacle power contacts 12 are positioned adjacent to a mating face of the mating port 14 for first engaging with and last disengaging from the first complementary connector to achieve the function of hot plug.

The second connector 2 comprises a second insulating housing 20 and a plurality of plug power contacts 22 retained in the second housing 20. The second housing 20 includes an L-shaped body 201, a mating tongue 202 extending rearwardly from a middle portion of the body 201 for mating with a complementary second connector (not shown), and a plate 203 extending rearwardly from the body 201 and parallel to the mating tongue 202 for latching with the complementary second connector. The second housing 20 defines a recess 204 in a front face thereof and a plurality of channels 205 extending from the mating tongue 202 through the body 201 to communicate with the recess 204. The body 201 is formed with a plurality of rearwardly extending posts 206 and latches 207 for being received in the holes 1021 and the slots 1022 of the first housing 10, respectively.

In conjunction with FIGS. 11–12, the plug power contacts 22 are inserted into the channels 205 of the second housing 20 and each comprise a first mating portion 220 received in the mating tongue 202 for engaging with the second complementary connector, and a second mating portion 222 extending forwardly beyond an inner face of the recess 204 for contacting with the connecting portion 122 of a corresponding receptacle power contact 12.

The cable 3 comprises a pair of wires 30 each include an insulating jacket 300, a pair of differential signal conductors 302 and a pair of ground conductors 304 exposed out of the jacket 300 at one end thereof.

Figure 4:
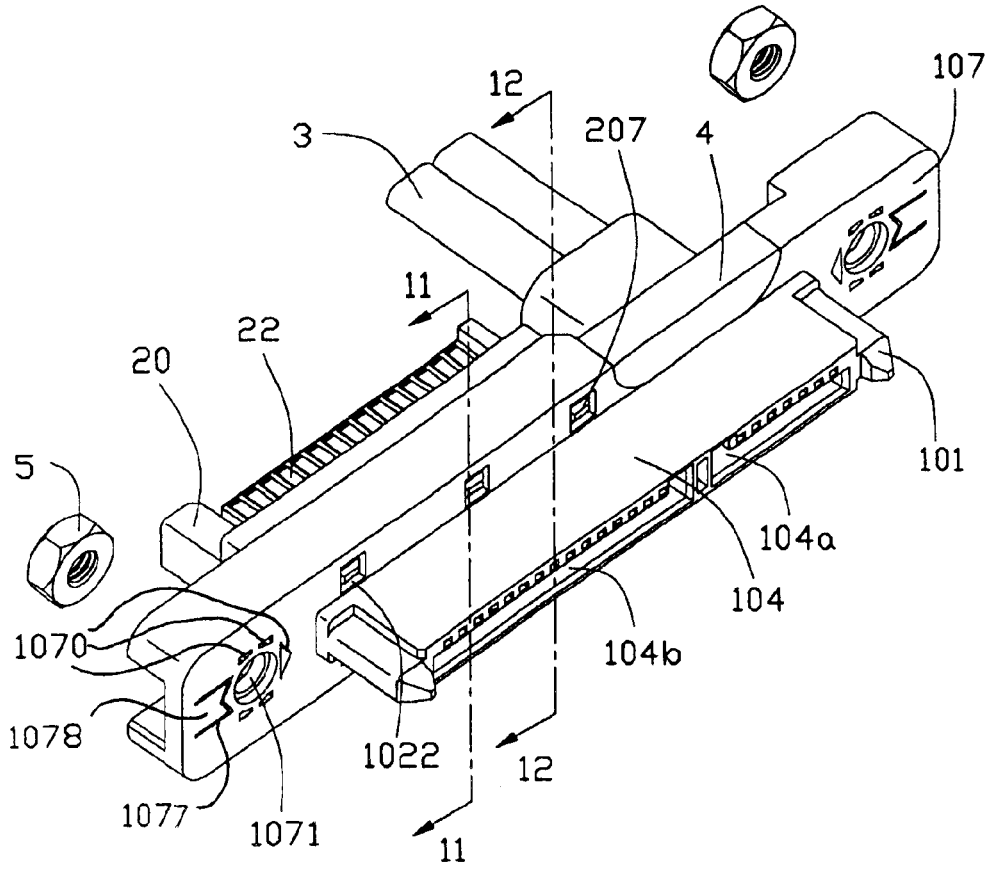
FIG. 4 is a partially assembled, perspective view of the cable assembly shown in FIG. 1.

Referring to FIGS. 4–6 in conjunction with FIGS. 1–3, four signal conductors 302 of the cable 3 are respectively soldered with the tail portions 112 of the four signal contacts of the first connector 1. One of the ground conductors 304 of each wire 30 is soldered with the tail portion 112 of a corresponding ground contact of the first connector 1, other two ground conductors 304 of the wires 30 are soldered to a common ground contact of the first connector 1.

The cover 4 is overmolded with the cable 3 and the first housing 10 after the wires 30 are soldered with the first contacts 11. The cover 4 has a pair of protrusions 40 received in the depressions 1024 of the first housing 10, and a pair of cutouts 42 receiving the barbs 1025 of the first housing 10.

Figure 7:
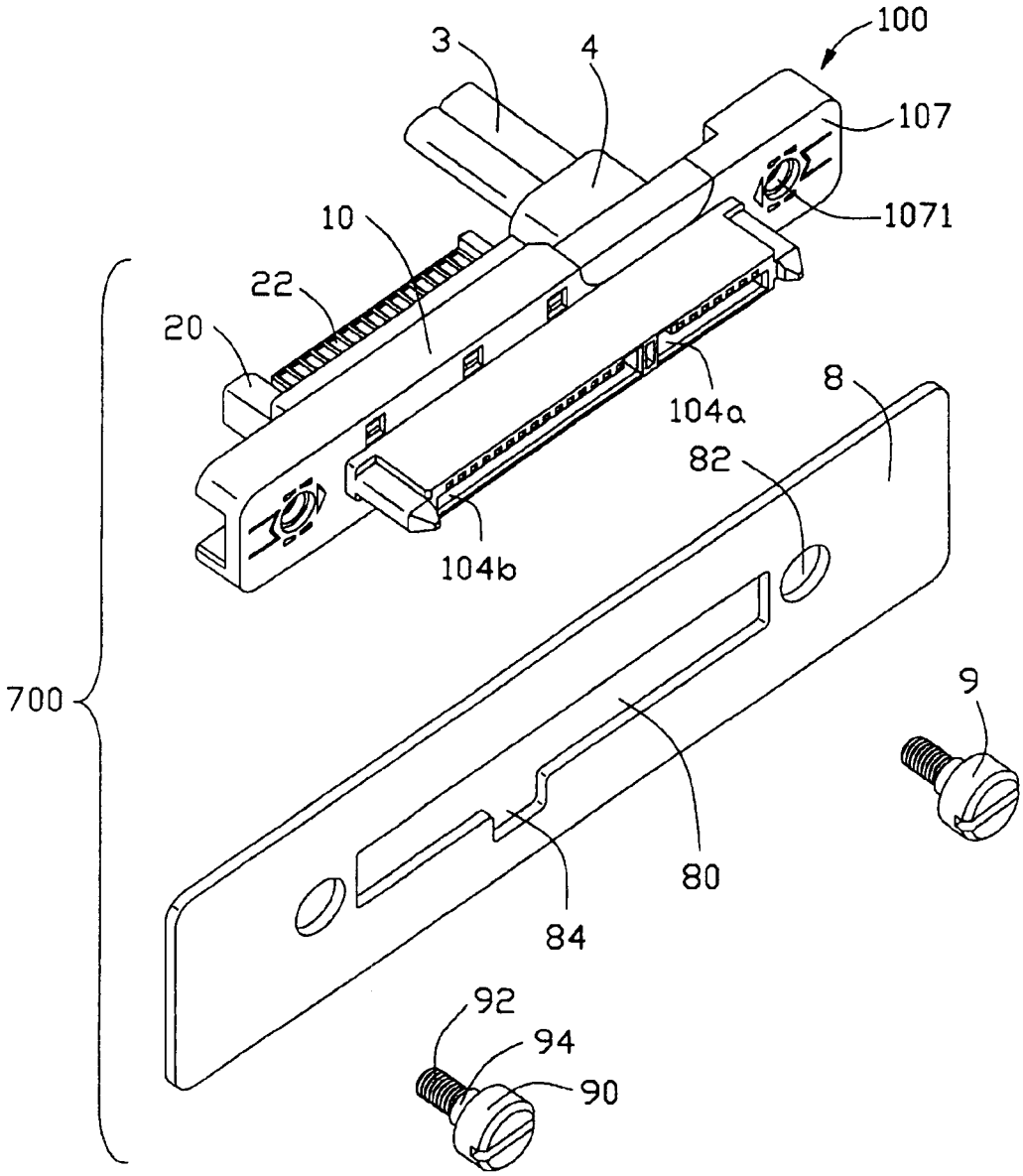
FIGS. 7–9 are different perspective views showing the cable assembly, a panel on which the cable assembly is mounted and a pair of bolts.
Figure 9:
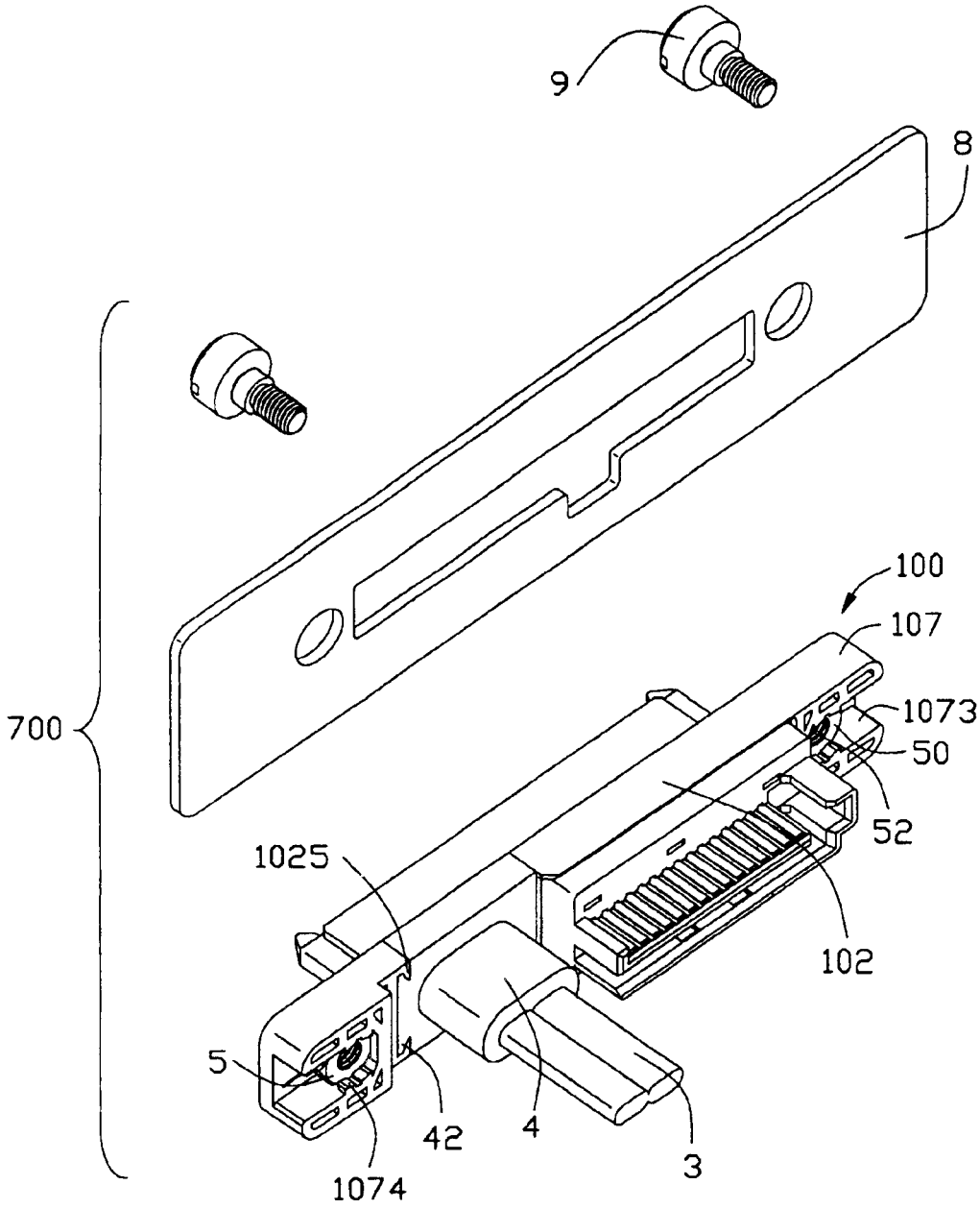
Figure 10:
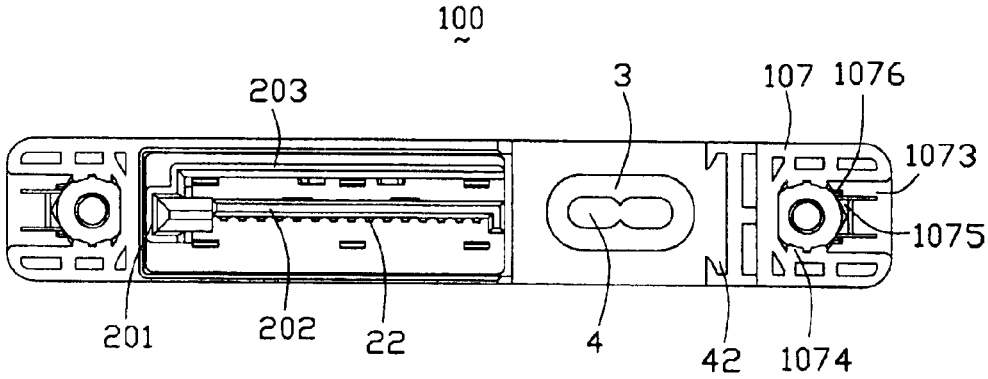
FIG. 10 is a front, plane view of the cable assembly of FIG. 6.

Referring to FIGS. 7–9 in conjunction with FIGS. 11–12, the second connector 2 is back to back assembled to the first connector 1 with the posts 206 received in the holes 1021 of the first housing 10 and with the latches 207 latching with corresponding projections 1022*a* in the slots 1022 to thereby interlocking the first connector 1 with the second connector 2. The second mating portions 222 of the plug power contacts 22 extend into the cavity 1020 of the first housing 10 and resiliently contact with the connecting portions 122 of the receptacle power contacts 12, respectively. The connecting portions 122 of the receptacle power contacts 12 partially extend into the recess 204 of the second housing 20. The cable assembly 1 is thus formed.

It can be understood that the cable assembly 100 is formed by integrating a cable connector with a power adaptor, wherein the cable connector comprises the first contacts 11 received in the first mating port 104*a* of the first housing 10 and the cable 3 electrically connecting with the first contacts 11 for signal transmission, and wherein the power adaptor includes the second contacts 12 received in the second mating port 104*b* of the first housing 10 and the second connector 2 electrically connecting with the second contacts 12 for power transmission.

Referring to FIGS. 7–9, a panel 8 in a computer system (not shown) to which the cable assembly 100 is mounted is shown. The cable assembly 100 is mounted to the panel 8 via a pair of bolts 9. The panel 8 defines an opening 80 and a pair of annular holes 82 at opposite sides of the opening. A cutout 84 is defined in the panel 8 and communicates with the opening 80. Each bolt 9 includes an enlarged operating portion 80, a threaded portion 82 and a middle portion 84 interconnecting the operating portion 80 with the threaded portion 82.

The cable assembly 100 is assembled to the panel 8 until the front face 102*a* abuts against the panel 8 and the polarizing key 108 is received in the cutout 84 of the panel 8 for polarization. The pair of bolts 9 respectively protrude through the annular holes 82 of the panel 8 and the mounting holes 1071 and thread with the threaded holes 52 of the pair of screw caps 5. Because of the existence of the first blocks 1074, the screw cap 5 has no possibility of separating from the fitting space 1073 of the first insulating housing 10 when threading with the bolt 9. Because of the existence of the second and the third blocks 1075, 1076, the screw cap 5 has no possibility of turn when threading with the bolt 5 or after thread. Therefore, the cable assembly 100 is assembled to the panel 8 reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a first connector comprising a first insulating housing extending in a first direction and a plurality of first and second contacts assembled to the first housing in a second direction perpendicular to the first direction, the first insulating housing defining a pair of fitting spaces in said first direction and a pair of mounting holes in said second direction and respectively communicating with the fitting spaces, each of the first and the second contacts comprising an engaging portion received in the first housing and an opposite connecting portion;

a cable comprising a plurality of conductors electrically connecting with the connecting portions of the first contacts;

a second connector comprising a second housing assembled to the first insulating housing in said second direction and a plurality of third contacts electrically connecting with the connecting portions of the second contacts; and a pair of screw caps assembled to the fitting spaces of the first insulating housing in said first direction.

2. The cable assembly as claimed in claim 1, wherein the fitting space is formed with a plurality of first blocks engaging with the screw cap for preventing the screw cap from separating from the fitting space in the second direction.

3. The cable assembly as claimed in claim 1, wherein the fitting space is formed with a second block and a third block extending in said first direction, and wherein the second and the third blocks respectively abut against the peripheral of the screw cap for preventing the screw cap from turning.

4. The cable assembly as claimed in claim 1, wherein the first contacts include signal and ground contacts, and the second and the third contacts are power contacts.

5. The cable assembly as claimed in claim 4, wherein the conductors of the cable include signal and ground conductors respectively connecting with the signal and the ground contacts.

6. The cable assembly as claimed in claim 5, wherein one of the ground contacts electrically connects with a pair of ground conductors.

7. The cable assembly as claimed in claim 1, wherein the second contacts electrically connect with the third contacts in a one on one relationship.

8. The cable assembly as claimed in claim 7, wherein each third contact comprises a mating portion resiliently abutting against the connecting portion of a corresponding second contact.

9. The cable assembly as claimed in claim 1, wherein the first housing defines a first and a second mating ports respectively receiving the first and the second contacts.

10. The cable assembly as claimed in claim 9, wherein the first housing includes, along the first direction thereof, an elongated base with the first and the second mating ports integrally extending from one side thereof, and with the cable and the second connector attached to the other side thereof, along the first direction.

11. The cable assembly as claimed in claim 10, wherein the base defines a cavity communicating with the second mating port, and the second housing defines a recess aligned with and communicating with the cavity, the second and the third contacts partially extending into the recess and the cavity, respectively.

12. The cable assembly as claimed in claim 11, wherein the base defines a plurality of holes and slots at upper and lower sides of the cavity, and the second housing is formed with a plurality of posts and latches received in the holes and the slots, respectively.

13. The cable assembly as claimed in claim 12, wherein the fitting spaces are respectively defined in the base.

14. The cable assembly as claimed in claim 10, further comprising a cover overmolded with the cable and the base.

15. The cable assembly as claimed in claim 1, wherein the second connector is configured with a Serial Advance Technology Attachment (Serial ATA) interface and includes a body, a mating tongue extending from a middle portion of the body for mating with a complementary connector, and a plate extending from the body and parallel to the mating tongue for latching with the complementary connector.

* * * * *